US008968110B2

(12) United States Patent
Bapst et al.

(10) Patent No.: US 8,968,110 B2
(45) Date of Patent: Mar. 3, 2015

(54) FREE-STANDING JUMPING DEVICE

(75) Inventors: David M. Bapst, South Wales, NY (US); John DeRubes, Grand Island, NY (US); Domenic T. Gubitosi, East Aurora, NY (US); Brian S. Kelly, East Aurora, NY (US); John Martin Maul, Machias, NY (US); Philip R. Pyrce, Amherst, NY (US); Robert W. Salmon, Buffalo, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 13/450,695

(22) Filed: Apr. 19, 2012

(65) Prior Publication Data

US 2013/0040747 A1 Feb. 14, 2013

Related U.S. Application Data

(63) Continuation of application No. 12/762,473, filed on Apr. 19, 2010, now Pat. No. 8,182,355, which is a continuation of application No. 11/403,192, filed on Apr. 13, 2006, now Pat. No. 7,727,076, which is a continuation-in-part of application No. 11/209,036, filed on Aug. 23, 2005, now Pat. No. 7,438,644, which is a continuation of application No. 10/772,338, filed on Feb. 6, 2004, now Pat. No. 6,932,709.

(51) Int. Cl.

| | |
|---|---|
| ***A63G 23/00*** | (2006.01) |
| ***A47D 13/10*** | (2006.01) |
| *A63B 22/16* | (2006.01) |

(52) U.S. Cl.

CPC ..... *A47D 13/107* (2013.01); *A47D 13/105* (2013.01)

USPC ..... 472/135; 472/103

(58) Field of Classification Search

USPC ..... 472/95, 103–105, 135; 482/69; 297/5, 297/273–275

See application file for complete search history.

(56) References Cited

U.S. PATENT DOCUMENTS

| | | | |
|---|---|---|---|
| 131,349 | A | 9/1872 | Holmes |
| 616,697 | A | 12/1898 | Cowles et al. |

(Continued)

FOREIGN PATENT DOCUMENTS

| | | |
|---|---|---|
| CA | 497983 | 12/1953 |
| DE | 3304443 | 8/1984 |
| WO | 2005117663 | 12/2005 |

OTHER PUBLICATIONS

Non-final Office Action in pending related U.S. Appl. No. 13/587,053—mailed Feb. 10, 2014 (5 pages).

*Primary Examiner* — Kien Nguyen

(74) *Attorney, Agent, or Firm* — Edell, Shapiro & Finnan, LLC

(57) ABSTRACT

An apparatus includes a support frame, a resilient member, a seat, and a retainer. The resilient member has a first end portion configured to be coupled to the support frame and a second end portion, opposite from the first end portion. The seat is configured to be coupled to the second end portion such that the seat is suspended from the support frame by the resilient member. At least one of the first end portion and the second end portion includes multiple sleeves, each defining an opening therein. A portion of the retainer is configured to be disposed within a first one of the sleeves and coupled to at least one of the seat and the support frame such that a position of the seat relative to the support frame is adjustable by disposing the portion of the retainer within a second one of the sleeves.

16 Claims, 21 Drawing Sheets

(56) References Cited

U.S. PATENT DOCUMENTS

| | | | | |
|---|---|---|---|---|
| 707,774 | A | 8/1902 | Blackledge | |
| 775,133 | A | 11/1904 | Gaines | |
| 1,256,548 | A | 2/1918 | Gannon | |
| 1,326,921 | A | 1/1920 | Dzimitowicz | |
| 1,428,039 | A | 9/1922 | Kratz | |
| 1,806,454 | A | 5/1931 | Goudeau | |
| 1,931,567 | A | 10/1933 | Arends | |
| 1,950,042 | A | 3/1934 | Upper | |
| 2,006,492 | A | 7/1935 | Van Santen | |
| 2,282,086 | A | 5/1942 | Peltier | |
| D137,437 | S | 3/1944 | Driscoll | |
| 2,347,754 | A | 5/1944 | Shay | |
| 2,521,422 | A | 9/1950 | Strand, Jr. et al. | |
| 2,645,271 | A | 7/1953 | Call et al. | |
| 2,700,413 | A | 1/1955 | Williams | |
| 2,715,935 | A | 8/1955 | Berry, Jr. | |
| 2,855,023 | A | 10/1958 | Mekeel et al. | |
| 3,029,551 | A | 4/1962 | Reiskin | |
| 3,462,113 | A | 8/1969 | Macleod | |
| 3,747,596 | A | 7/1973 | Mills | |
| 3,765,674 | A | 10/1973 | Siler | |
| 3,796,430 | A | 3/1974 | Sudo | |
| 3,992,023 | A | 11/1976 | Moorer | |
| 4,025,083 | A | 5/1977 | Saint | |
| 4,045,045 | A | 8/1977 | Boucher et al. | |
| 4,084,812 | A | 4/1978 | Melrose et al. | |
| 4,094,547 | A | 6/1978 | Zampino et al. | |
| 4,101,165 | A * | 7/1978 | Hammer | 297/273 |
| 4,123,078 | A | 10/1978 | Murakami | |
| 4,140,311 | A | 2/1979 | Murakami | |
| 4,141,095 | A | 2/1979 | Adachi | |
| 4,171,132 | A | 10/1979 | Kassai | |
| 4,171,847 | A | 10/1979 | Tukui | |
| 4,205,670 | A | 6/1980 | Owens | |
| 4,225,146 | A | 9/1980 | Takeuchi | |
| 4,231,582 | A | 11/1980 | Moss | |
| 4,298,228 | A | 11/1981 | Zampino et al. | |
| 4,359,045 | A | 11/1982 | Cozzi | |
| 4,359,242 | A | 11/1982 | Gerken et al. | |
| 4,364,576 | A | 12/1982 | Kassai | |
| 4,553,786 | A | 11/1985 | Lockett, III et al. | |
| 4,576,392 | A | 3/1986 | Quinlan, Jr. | |
| 4,615,523 | A | 10/1986 | Chen | |
| 4,699,392 | A | 10/1987 | Ku | |
| 4,822,030 | A | 4/1989 | Cone | |
| 4,836,534 | A | 6/1989 | Lewis | |
| 4,948,120 | A | 8/1990 | Krueger et al. | |
| 5,052,749 | A | 10/1991 | Groenendijk | |
| 5,054,851 | A | 10/1991 | Chiu | |
| 5,082,325 | A | 1/1992 | Sedlack | |
| D327,777 | S | 7/1992 | Tepper | |
| 5,156,176 | A | 10/1992 | Doorenbos | |
| 5,172,955 | A | 12/1992 | Freese et al. | |
| 5,201,693 | A | 4/1993 | Sparkes | |
| 5,207,478 | A | 5/1993 | Freese et al. | |
| 5,328,410 | A | 7/1994 | Amburgey et al. | |
| 5,407,246 | A | 4/1995 | Meeker et al. | |
| 5,445,585 | A | 8/1995 | Meeker | |
| 5,451,093 | A | 9/1995 | Petrie et al. | |
| 5,490,711 | A | 2/1996 | Pollock | |
| 5,499,949 | A | 3/1996 | Heubl | |
| 5,509,721 | A | 4/1996 | Huang | |
| D376,052 | S | 12/1996 | Cone et al. | |
| D378,554 | S | 3/1997 | Meeker et al. | |
| 5,615,428 | A | 4/1997 | Li | |
| 5,624,321 | A | 4/1997 | Snyder | |
| 5,642,750 | A | 7/1997 | Brown et al. | |
| 5,645,489 | A | 7/1997 | Laiche et al. | |
| 5,688,211 | A | 11/1997 | Myers | |
| 5,690,383 | A | 11/1997 | Meeker | |
| 5,700,201 | A | 12/1997 | Bellows et al. | |
| 5,704,576 | A | 1/1998 | Meeker et al. | |
| 5,704,882 | A | 1/1998 | Coates et al. | |
| 5,728,030 | A | 3/1998 | Hsieh et al. | |
| D395,467 | S | 6/1998 | Bellows | |
| 5,816,983 | A | 10/1998 | Dawes et al. | |
| 5,857,944 | A | 1/1999 | Cone et al. | |
| 5,868,459 | A | 2/1999 | Welsh, Jr. | |
| 5,876,311 | A | 3/1999 | Coates et al. | |
| 5,930,854 | A | 8/1999 | O'Neill et al. | |
| 5,934,747 | A | 8/1999 | Garland | |
| 5,947,875 | A | 9/1999 | Cone et al. | |
| 5,975,628 | A | 11/1999 | Russell | |
| 6,030,039 | A | 2/2000 | Essler | |
| 6,036,604 | A | 3/2000 | Klitsner | |
| 6,048,290 | A | 4/2000 | Chen et al. | |
| 6,170,840 | B1 | 1/2001 | Mathias | |
| 6,179,376 | B1 | 1/2001 | Meeker et al. | |
| 6,244,606 | B1 | 6/2001 | Yang | |
| 6,299,247 | B1 | 10/2001 | Meeker et al. | |
| 6,319,138 | B1 | 11/2001 | Fair et al. | |
| 6,383,085 | B1 | 5/2002 | Tseng | |
| 6,520,862 | B1 | 2/2003 | Armbruster et al. | |
| 6,540,579 | B1 | 4/2003 | Gubitosi et al. | |
| 6,592,425 | B2 | 7/2003 | Bapst et al. | |
| 6,599,198 | B2 * | 7/2003 | Ettenhofer | 472/104 |
| 6,648,411 | B2 | 11/2003 | Julien | |
| 6,932,709 | B1 | 8/2005 | Gubitosi et al. | |
| 6,994,630 | B2 | 2/2006 | Paesang | |
| 2002/0002741 | A1 | 1/2002 | Tomas et al. | |
| 2002/0027382 | A1 | 3/2002 | Bellows et al. | |
| 2002/0043824 | A1 | 4/2002 | Bellows et al. | |
| 2002/0043825 | A1 | 4/2002 | Bellows et al. | |
| 2002/0115535 | A1 | 8/2002 | Stern et al. | |
| 2002/0164917 | A1 | 11/2002 | Keegan et al. | |
| 2003/0020317 | A1 | 1/2003 | Keegan et al. | |
| 2003/0222421 | A1 | 12/2003 | Myers et al. | |
| 2004/0119258 | A1 | 6/2004 | Yoo | |

* cited by examiner

FREE-STANDING JUMPING DEVICE

CROSS-REFERENCE TO RELATED APPLICATIONS

This application is a continuation of U.S. patent application Ser. No. 12/762,473, filed on 19 Apr. 2010 and entitled "Free-Standing Jumping Device", which is a continuation of U.S. patent application Ser. No. 11/403,192, now U.S. Pat. No. 7,727,076, filed on 13 Apr. 2006 and entitled "Free-Standing Jumping Device", which is a continuation-in-part of U.S. patent application Ser. No. 11/209,036, now U.S. Pat. No. 7,438,644, filed on 23 Aug. 2005 and entitled "Free-Standing Jumping Device", which is a continuation of U.S. patent application Ser. No. 10/772,338, now U.S. Pat. No. 6,932,709, filed 6 Feb. 2004 and entitled "Free-Standing Jumping Device". The disclosure of each of the aforementioned applications is incorporated herein by reference in its entirety.

BACKGROUND

The invention relates generally to children's activity toys, and more particularly to children's jumpers and free-standing jumpers.

Swings, jumpers, bouncers and other similar devices are typically used to keep a child entertained and stimulated in a safe location. Additionally, such devices also provide an environment that promotes the development of a child's gross motor skills Known jumpers, however, are often inconvenient to use, difficult to store, and not adjustable to accommodate children of different sizes.

For example, some known jumpers can be suspended from an available structure, such as a doorframe. Such known jumpers, however, can impede movement of others through the doorway. Additionally, suitable doorframes are not always available or convenient. Moreover, such devices may not provide the level of security desired by some caretakers. Other known jumpers include a support frame from which a seat is suspended. Such known jumpers can be difficult to adjust to accommodate children of different sizes.

Thus, there is a need for a device that can be easily stored and moved. Also, a need exists for a jumper that is free-standing with a stable base and that is easily adjustable.

SUMMARY OF THE INVENTION

Children's jumping apparatuses are described herein. In one embodiment an apparatus includes a support frame, a resilient member, a seat, and a retainer. The resilient member has a first end portion configured to be coupled to the support frame and a second end portion, opposite from the first end portion. The seat is configured to be coupled to the second end portion such that the seat is suspended from the support frame by the resilient member. At least one of the first end portion and the second end portion includes multiple sleeves, each defining an opening therein. A portion of the retainer is configured to be disposed within a first one of the sleeves and to be coupled to at least one of the seat and the support frame such that a position of the seat relative to the support frame is adjustable by disposing the portion of the retainer within a second one of the sleeves, the second sleeve being different from the first sleeve.

DETAILED DESCRIPTION OF THE INVENTION

Figure 1A:
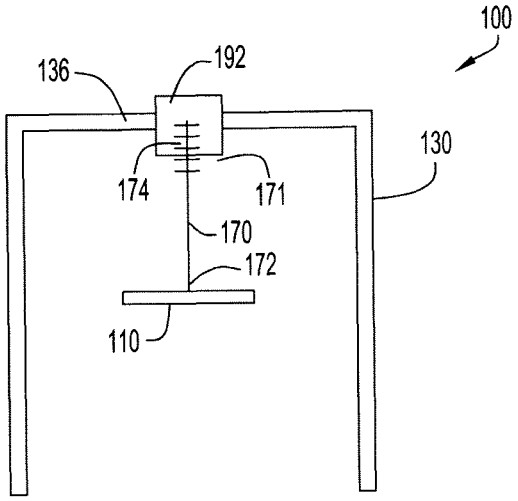
FIGS. 1A and 1B are schematic illustrations of a jumping device according to an embodiment of the invention in a first position and a second position, respectively.

Children's jumping apparatuses are described herein. In one embodiment an apparatus includes a support frame, a resilient member, a seat, and a retainer. The resilient member has a first end portion configured to be coupled to the support frame and a second end portion, opposite from the first end portion. The seat is configured to be coupled to the second end portion such that the seat is suspended from the support frame by the resilient member. At least one of the first end portion and the second end portion includes a set sleeves, each defining an opening therein. A portion of the retainer is configured to be disposed within a first sleeve from the set of sleeves and to be coupled to at least one of the seat and the support frame. In this manner, a position of the seat relative to the support frame is adjustable by disposing the portion of the retainer within a second sleeve from the set sleeves, the second sleeve being different from the first sleeve.

In some embodiments, the second end portion of the resilient member includes a set of sleeves and the seat includes an attachment portion having a top surface and a bottom surface. The attachment portion of the seat defines an opening between the top surface and the bottom surface. The second end portion of the resilient member is configured to be disposed within the opening such that at least one sleeve is disposed below the bottom surface. The retainer is configured to be removably coupled to the bottom surface of the attachment portion. In this manner, the position of the seat relative to the support frame is adjustable by disposing a portion of the retainer within the desired sleeve.

In some embodiments, the first end portion of the resilient member includes a set of sleeves and the support frame includes an attachment member having a first surface and a second surface. The attachment member defines an opening between the first surface and the second surface. The first end portion of the resilient member is configured to be disposed within the opening such that at least one sleeve is disposed adjacent the first surface. The retainer is configured to be removably coupled to the first surface of the attachment member. In this manner, the position of the seat relative to the support frame is adjustable by disposing a portion of the retainer within the desired sleeve.

In yet other embodiments, an apparatus includes a support frame, a resilient member, a seat and a retainer. The resilient member has a first end portion, a second end portion and a central portion located between the first end portion and the second end portion. At least one of the first end portion and the second end portion includes a set of sleeves, each defining an opening therein. The central portion of the resilient member is configured to cooperate with the support frame. For example, in some embodiments, a portion of the central portion of the resilient member is configured to be disposed within a portion of the support frame. The seat is configured to be coupled to the first end portion of the resilient member and the second end portion of the resilient member such that the seat is suspended from the support frame by the resilient member. A portion of the retainer is configured to be disposed within a first sleeve from the set of sleeves and to be coupled to the seat. In this manner, a position of the seat relative to the support frame is adjustable by disposing the portion of the retainer within a second sleeve from the set of sleeves.

In yet other embodiments, an apparatus includes a seat, a support frame, a resilient member and a retainer. The resilient member has a first end portion, a second end portion and a central portion located between the first end portion and the second end portion. At least one of the first end portion and the second end portion includes a set of sleeves, each defining an opening therein. The first end portion and the second end portion are configured to be coupled to the support frame while the central portion is configured to be coupled to the seat such that the seat is suspended from the support frame by the resilient member. A portion of the retainer is configured to be disposed within a first sleeve from the plurality of sleeves and coupled to the support frame such that a position of the seat relative to the support frame is adjustable by disposing the portion of the retainer within a second sleeve from the plurality of sleeves.

In yet other embodiments, an apparatus includes a support frame, a first resilient member, a second resilient member, a child support member and a seat. The support frame has a first and a second A-shaped frame portion, each having a first leg, a second leg and an apex. The second A-shaped frame portion is spaced laterally from the first A-shaped frame portion. The support frame has a ground-engaging portion configured to be coupled to each of the first and the second A-shaped frame portions. The first resilient member has a first end portion coupled to at least one of the first leg and the second leg of the first frame portion substantially spaced beneath the apex of the first frame portion and a second end portion opposite from the first end portion. The second resilient member has a first end portion coupled to at least one of the first leg and the second leg of the second frame portion substantially spaced beneath the apex of the second frame portion and a second end portion opposite from the first end portion. The child support member is configured to be coupled to the second end portion of the first resilient member and the second end portion of the second resilient member such that the child support member is suspended from the first frame portion and the second frame portion by the resilient members. The seat is rotatably coupled to the child support member.

Figure 1B:
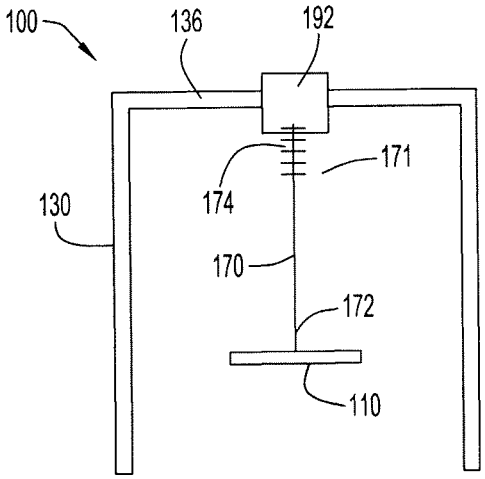

FIGS. 1A and 1B are schematic illustrations of a jumping device 100 according to an embodiment of the invention in a first position and a second position, respectively. The illustrated jumping device 100 includes a support frame 130, a resilient member 170, a child support member 110 and a retainer 192. The resilient member 170 has a first end portion 171 and a second end portion 172 coupled to the child support member 110. The first end portion 171 of the resilient member 170 includes a set of sleeves 174. The retainer 192, a portion of which is disposed within a sleeve from the set of sleeves 174, is coupled to an overhead member 136 of the support frame 130. In this manner, the first end portion 171 of the resilient member 170 is coupled to the support frame 130 such that the child support member 110 is suspended from the support frame 130. The position of the child support member 110 relative to the support frame 130 can be selectively adjusted by disposing the portion of the retainer 192 within a different sleeve from the set of sleeves 174. For example, depending on the sleeve in which the retainer 192 is disposed, the length of the resilient member 170 can be effectively shortened, thereby raising the position of the child support member 110, as shown in FIG. 1A. Conversely, by selecting a different sleeve from the set of sleeves 174, the length of the resilient member 170 can be effectively lengthened, thereby lowering the position of the child support member 110, as shown in FIG. 1B. In this manner, the jumping device 100 can be reconfigured to accommodate children of varying ages and sizes.

Figure 2A:
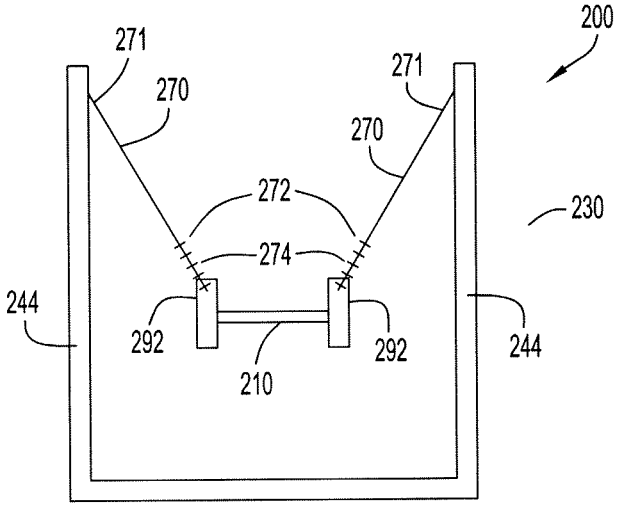
FIGS. 2A and 2B are schematic illustrations of a jumping device according to an embodiment of the invention in a first position and a second position, respectively.
Figure 2B:
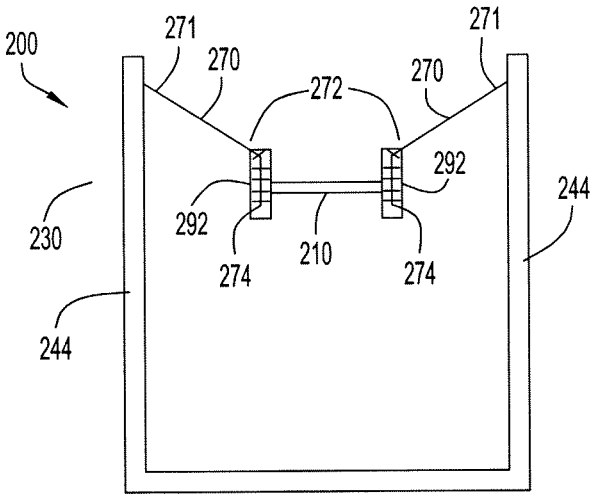

FIGS. 2A and 2B are schematic illustrations of a jumping device 200 according to an embodiment of the invention in a first position and a second position, respectively. The illustrated jumping device 200 includes a support frame 230, two resilient members 270, a child support member 210 and two retainers 292. Each of the resilient members 270 has a first end portion 271 and a second end portion 272. The first end portion 271 of each resilient member 270 is coupled to an upright portion 244 of the support frame 230. The second end portion 272 of each resilient member 270 includes a set of sleeves 274. A portion of each of the retainers 292 is disposed within a sleeve from the set of sleeves 274 and is coupled to the child support member 210. In this manner, the second end portion 272 of each resilient member 270 is coupled to the child support member 210 such that the child support member 210 is suspended from the upright portions 244 of the support frame 230. The position of the child support member 210 relative to the support frame 230 is selectively adjustable by disposing the portion of each retainer 292 within a different sleeve from the set of sleeves 274 in each resilient member 270, as described above. For example, the length of the resilient members 270 can be effectively shortened, thereby raising the position of the child support member 210, as shown in FIG. 2B. Conversely, the length of the resilient members 270 can be effectively lengthened, thereby lowering the position of the child support member 210, as shown in FIG. 2A.

Figure 8:
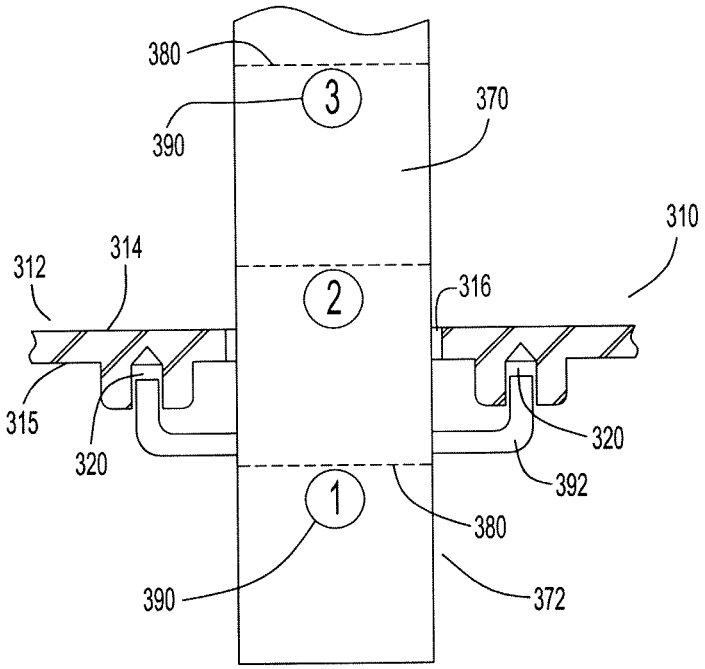
FIG. 8 is a cross-sectional view taken along section A-A of of the jumping device illustrated in FIG. 4A.

FIGS. 3-6 and 8 illustrate a jumping device 300 according to an embodiment of the invention that includes a support frame 330, three resilient members 370, a child support member 310 and at least one retainer 392 (see FIG. 8). Each of the resilient members 370 has a first end portion 371 and a second end portion 372. The first end portion 371 of each resilient member 370 is coupled to the support frame 330. The second end portion 372 of each resilient member 370 includes a set of sleeves 374 (see FIGS. 5 and 6). A portion of each retainer 392 is disposable within a sleeve from the set of sleeves 374 (see FIG. 8). Each retainer is coupled to the child support member 310, thereby coupling the second end portion 372 of each resilient member 370 to the child support member 310 such that the child support member 310 is suspended from the support frame 330. As discussed herein, the position of the child support member 310 relative to the support frame 330 is selectively adjustable by disposing the portion of each retainer 392 within a different sleeve from the set of sleeves 374 in each resilient member 370.

Figure 3:
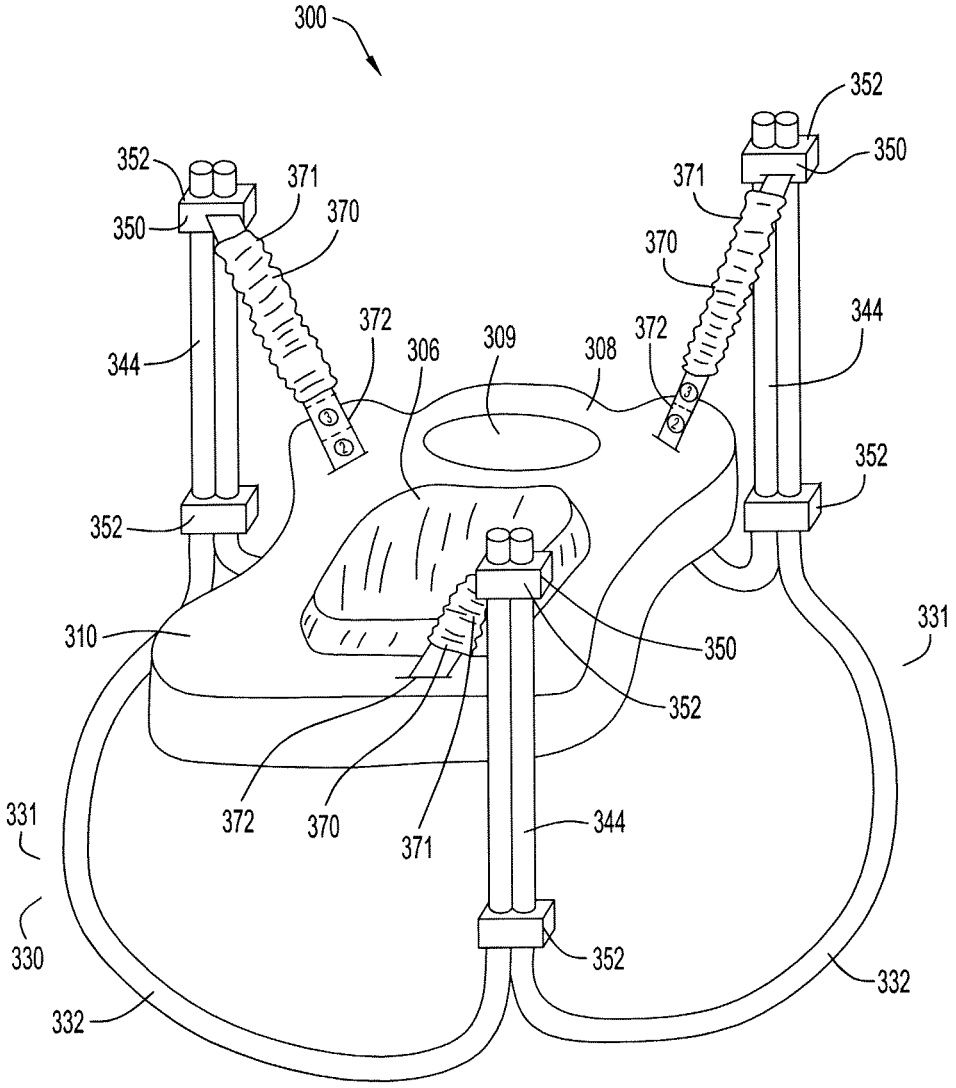
FIG. 3 is a perspective view of a jumping device according to an embodiment of the invention.

As illustrated in FIG. 3, the support frame 330 includes three upright members 331 removably coupled together by a series of connectors 352. Each of the upright members 331 includes a base portion 332 and two upright portions 344. The upright members 331 can be constructed of aluminum, steel, plastic or any other suitable material. The connectors 352 can be, for example, plastic clips configured to be removably coupled to a portion of the upright portion 344 of adjacent upright members 331. In some embodiments, the connectors 352 are configured to be fixedly coupled to the upright portion 344 of one upright member 331 while removably coupled to the upright portion 344 of the adjacent upright member 331 via an interference fit. In this manner, when the jumping device 300 is disassembled, the connectors 352 remain connected to one upright member 331, thereby preventing them from being misplaced.

In the illustrated embodiment, each of the resilient members 370 has a first end portion 371 and a second end portion 372. The first end portion 371 of each resilient member 370 is coupled to the upright portion 344 of an upright member 331 by an attachment member 350. In the illustrated embodiment, the attachment members 350 can also act as connectors 352 to couple the upright portions 344 of adjacent upright members 331. In other embodiments, the attachment members 350 are distinct from the connectors 352. In yet other embodiments, the attachment members 350 are not separate components, but rather, are integral to the upright portions 344 of the upright members 331. In some embodiments the first end portion 371 is fixedly attached to the attachment member 350. For example, the first end portion 371 can be molded into a portion of the attachment member 350. In other embodiments, the first end portion 371 is removably attached to the attachment member 350. For example, the first end portion 371 of the resilient member 370 can be coupled to the attachment member 350 by a fastener, an elastic strap, or by a sleeve-and-retainer combination.

Figure 4A:
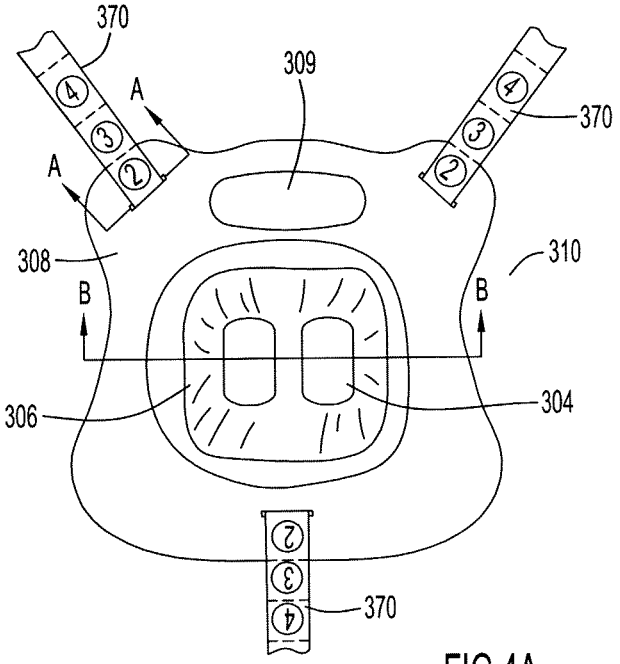
FIG. 4A is a plan view of the child support portion of the jumping device illustrated in FIG. 3.
Figure 4B:
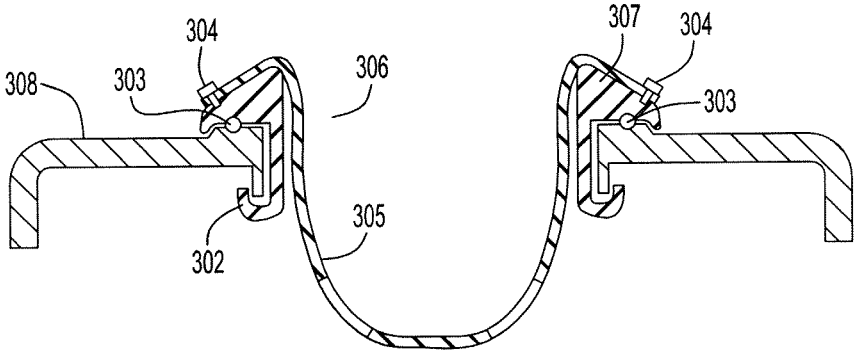
FIG. 4B is a cross-sectional view taken along section B-B of the of the jumping device illustrated in FIG. 4A.

The child support member 310 includes a tray portion 308 and a seat 306. The second end portion 372 of each resilient member 370 is coupled to the child support member 310 such that the child support member 310 is suspended from the support frame 330. As illustrated in FIGS. 4A and 4B, the seat 306 is coupled to and supported by the tray portion 308. The seat 306 includes a padded material 305 suitable for comfortable seating of a child and a seat frame 307 that supports the padded material 305. The padded material 305 is removably coupled to the seat frame 307 by a series of fasteners 304, such as snaps or buttons. In this manner the padded material 305 can be easily removed for cleaning.

In some embodiments, the seat 306 is rotatably coupled to the tray portion 308 to allow a child to freely spin while positioned in the seat 306. In the illustrated embodiment, the rotational coupling is accomplished, for example, by disposing a set of ball bearings 303 between the seat frame 307 and the tray portion 308, as illustrated in FIG. 4B. The seat frame 307 includes a retaining portion 302 to prevent the seat frame 307 from being inadvertently removed from the tray portion 308. Other suitable mechanisms for rotatably coupling the seat 306 to the tray portion 308 are described, for example, in U.S. Pat. No. 7,244,165, entitled "Entertainment Toy Having Multiple Configurations," which is incorporated herein by reference in its entirety.

The tray portion 308 includes a recessed area 309 configured to retain food, drinks and/or toys for entertaining a child. In some embodiments, the tray portion 308 includes an attachment member (not shown in FIGS. 4A and 4B) configured to receive toys. Such an attachment member can include, for example, a rod from which toys can be suspended and/or a mounting member to which a base portion of a toy can be mounted.

Figure 5:
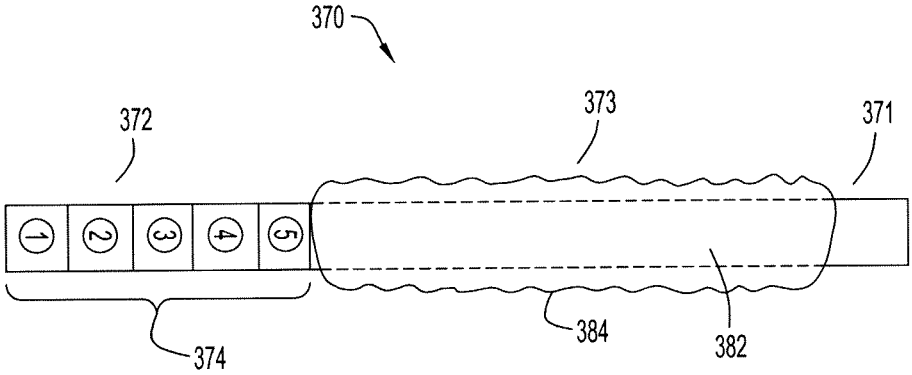
FIG. 5 is a plan view of a resilient member of the jumping device shown in FIG. 3.

FIG. 5 is a plan view of a resilient member 370 of the jumping device 300 shown in FIG. 3. The resilient member 370 includes a first end portion 371, a second end portion 372 and a central portion 373. The first end portion 371 and the second end portion 372 are flexible and substantially inelastic. As discussed above, the first end portion 371 is coupled to the upright portion 344 of an upright member 331 by an attachment member 350. In some embodiments, the resilient member 370 is monolithically formed such that the first end portion 371 and the second end portion 372 are flexible and substantially inelastic while the central portion 373 includes an elastic portion 382. Suitable materials for the end portions 371, 372 of the resilient member include plastic, nylon, polyester, leather, and the like. Suitable materials for the elastic portion 382 include any suitable elastomer, such as rubber.

A cover 384 is disposed about a portion of the resilient member 370 to provide a more comfortable surface for the child to grasp the resilient member 370. The cover 384 is fabricated from a material sufficiently thick to protect the child against uncomfortable edges that may be present on the resilient member 370, but pliable enough to expand and contract with the elastic portion 382 of the resilient member 370 during movement of child support member 310. Suitable materials for cover 384 include soft plastic, leather, nylon, and the like.

Figure 7:
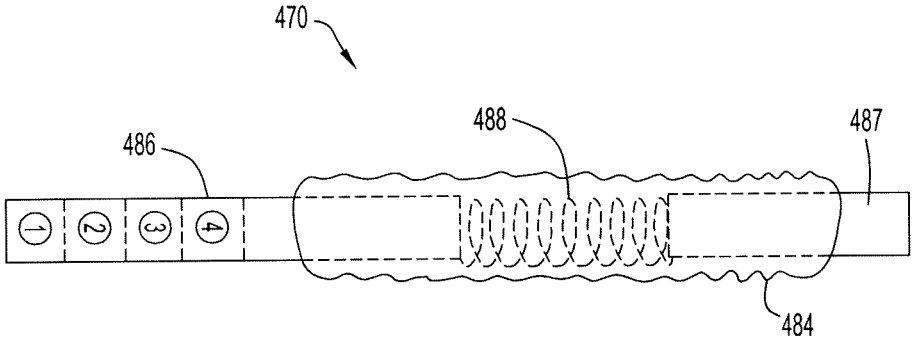
FIG. 7 is a plan view of a resilient member of a jumping device according to an embodiment of the invention.

In other embodiments, the resilient member includes separate components joined to form the resilient member. For example, as illustrated in FIG. 7, in some embodiments, a resilient member 470 includes a first strap 487, a second strap 486 and a spring 488 coupled to and disposed between the first strap 487 and the second strap 486. A cover 484 is disposed about a portion of the resilient member 470 to prevent pinch points in the spring 488 from being exposed to the child as the spring expands and contracts when the child support member moves. As described above, the cover 484 is fabricated from a material sufficiently thick to protect the child against pinching, but pliable enough to expand and contract with the spring 488 during movement of child support member.

Figure 6:
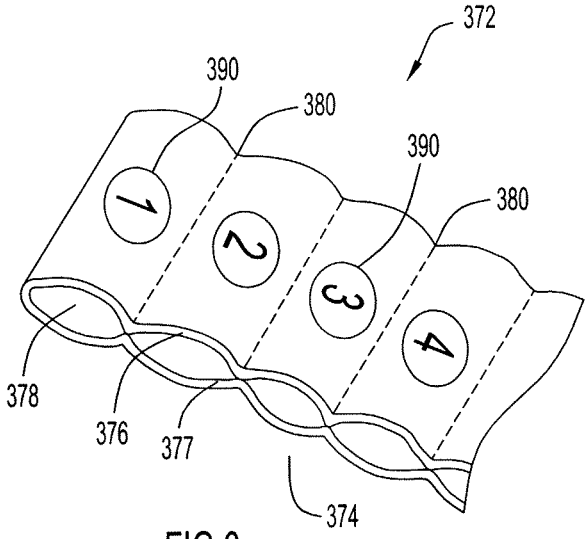
FIG. 6 is a perspective view of an end portion of a resilient member of the jumping device illustrated in FIG. 3.

As illustrated in FIGS. 5 and 6, the second end portion 372 of the resilient member 370 includes a set of sleeves 374. The set of sleeves 374 is formed by coupling a first sleeve portion 376 and a second sleeve portion 377 at predefined locations 380 to form a set of openings 378. The first sleeve portion 376 and second sleeve portion 377 can be coupled, for example, by stitching, adhesive or any other suitable means. In other embodiments, the resilient member is monolithically formed, such as by an extrusion process, to include the set of sleeves.

Each sleeve from the set of sleeves 374 includes visual indicia 390, such as a reference numeral, that indicates the relative position in which the second end portion 372 is coupled to the child support member 310. In other embodiments, the visual indicia can be color, a figure or any other suitable indicia for indicating the relative position of the second end portion of the resilient member. In some embodiments, the visual indicia are associated with the height and/or weight of the child to be placed in the jumping device.

The second end portion 372 of each resilient member 370 is coupled to the child support member 310 such that the child support member 310 is suspended from the support frame 330. More specifically, as illustrated in FIG. 8, the child support member 310 includes an attachment portion 312 having a top surface 314 and a bottom surface 315. The attachment portion 312 defines an opening 316 between the top surface 314 and the bottom surface 315 that receives the second end portion 372 of the resilient member 370. A portion of the retainer 392 is disposed within the opening 378 of a sleeve from the set of sleeves 374 and the retainer 392 is coupled to the bottom surface 315 of the attachment portion 312 of the child support member 310. In some embodiments, the bottom surface 315 of the attachment portion 312 defines a set of holes 320 configured to receive a portion of the retainer 392. The holes 320 are sized to provide an interference fit with the mating portion of the retainer 392, thereby ensuring that the retainer 392 remains coupled to the bottom surface 315 when the jumping device 300 is in use. In this manner, the position of the child support member 310 relative to the support frame 330 can be selectively adjusted by disposing a portion of the retainer within the desired sleeve from the set of sleeves 374.

Figure 9A:
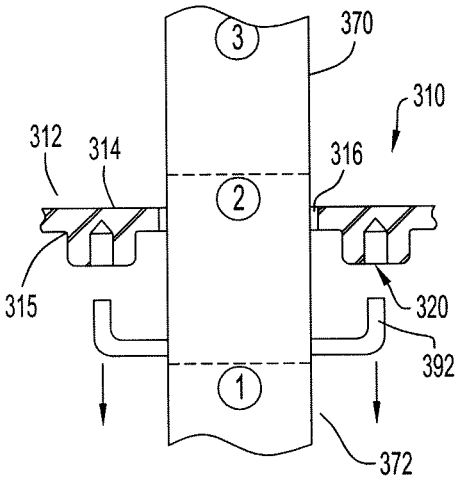
FIGS. 9A-9D are cross-sectional views taken along section A-A of the jumping device illustrated in FIG. 4A showing the operation of the adjustment mechanism.
Figure 9B:
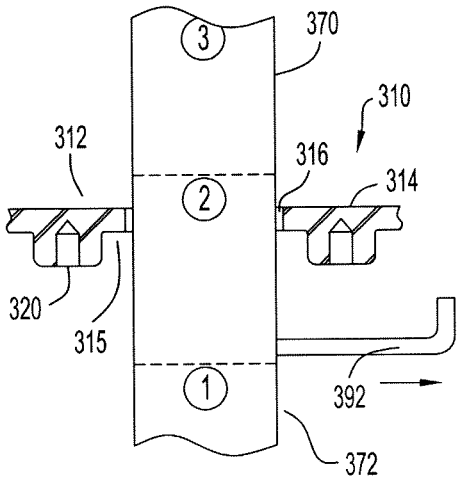
Figure 9C:
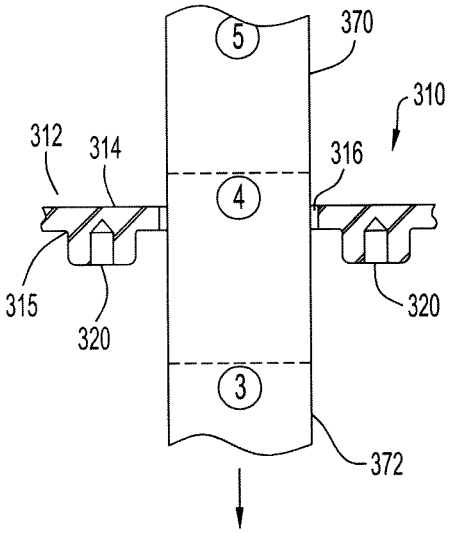
Figure 9D:
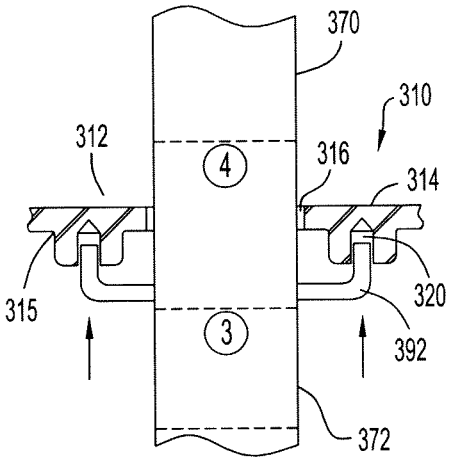

The position of the child support member 310 can be repeatedly adjusted as illustrated in FIGS. 9A-9D. As shown in FIG. 9A, the user first removes the retainer 392 from the bottom surface 315 of the attachment portion 312. The user then removes the retainer 392 from the opening 378 of the sleeve (FIG. 9B) and repositions the second end portion 372 of the resilient member 370 as desired (FIG. 9C). Finally, as shown in FIG. 9D, the user reinserts the retainer 392 into the opening 378 of the desired sleeve and couples the retainer 392 to the bottom surface 315 by inserting the ends of the retainer 392 into the mating holes 320.

Figure 10A:
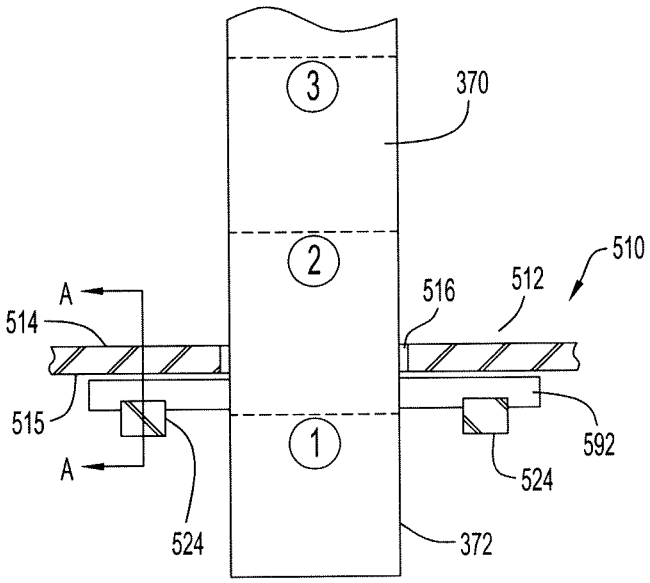
FIG. 10A is a cross-sectional view of an attachment portion of a jumping device according to an embodiment of the invention.
Figure 10B:
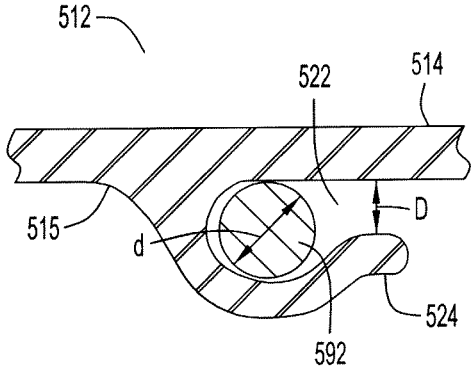
FIG. 10B is a cross-sectional view taken along section A-A of the attachment portion of the jumping device illustrated in FIG. 10A.

Although retainer 392 illustrated in FIG. 8 is coupled to the bottom surface 315 of the attachment portion 312 via mating holes 320, other suitable coupling mechanisms are contemplated. For example, in the embodiment shown in FIGS. 10A and 10B, a child support member 510 includes an attachment portion 512 having a top surface 514 and a bottom surface 515. The attachment portion 512 defines an opening 516 between the top surface 514 and the bottom surface 515 that receives the second end portion 372 of the resilient member 370, as described above. The bottom surface 515 includes two clip portions 524, each defining an opening 522 configured to receive a portion of the retainer 592. As illustrated in FIG. 10B, the depth D at the entry portion of each opening 522 is smaller than the diameter d of retainer 592, thereby allowing the retainer 592 to be securely coupled to the bottom surface 515 of the attachment portion 512. The retainer 592 can be removed from the opening 522 by displacing the edge of the clip portion 524 away from the bottom surface 515 of the attachment portion 512, thereby increasing the depth D.

In illustrated embodiment, the attachment portion 512 is monolithically formed to include the clip portions 524. In other embodiments, however, the clip portions 524 are separate components, such as, for example, thin metallic strips, coupled to the bottom surface of the attachment portion. In yet other embodiments, the openings are defined by a single clip portion.

Figure 11:
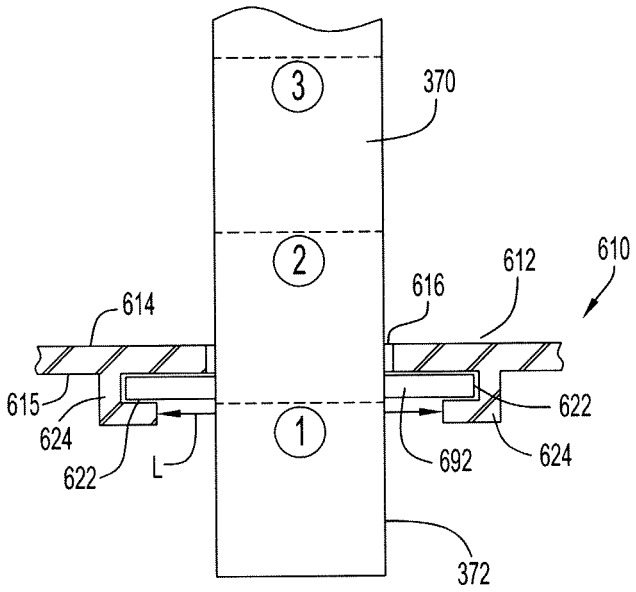
FIG. 11 is a cross-sectional view of an attachment portion of a jumping device according to an embodiment of the invention.
Figure 12:
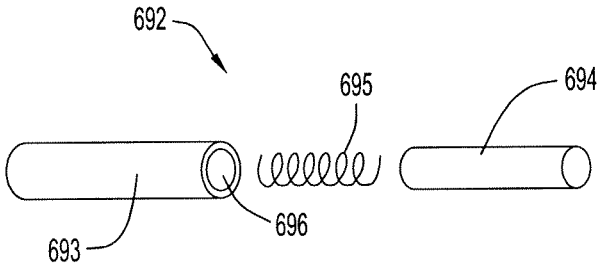
FIG. 12 is an exploded view of the retainer illustrated in FIG. 11.

Another mechanism for coupling the retainer to the attachment portion includes a variable length retainer 692 as illustrated in FIGS. 11 and 12. The retainer 692 includes a first end portion 693, a second end portion 694 and a biasing member 695. The first end portion includes a bore 696 configured to slidably receive a portion of the second end portion 694. As illustrated in FIG. 12, the biasing member 695 is disposed within the bore 696 such that it exerts an force on the first end portion 693 and the second end portion 694. In use, the length of the retainer 692 can be varied by applying an external force to the end portions 693, 694 such that the second end portion 694 is pushed further into the bore 696 of the first end portion 693.

As illustrated in FIG. 11, a child support member 610 includes an attachment portion 612 having a top surface 614 and a bottom surface 615, as described above. The attachment portion 612 defines an opening 616 between the top surface 614 and the bottom surface 615 that receives the second end portion 372 of the resilient member 370, as described above. The bottom surface 615 includes two clip portions 624, defining two opposing openings 622. Each opening 622 is configured to receive an end portion 693, 694 of the retainer 692. In use, the retainer 692 is inserted into the openings 622 by applying a force to the end portions 693, 694 (i.e., squeezing the end portions together), until the length of the retainer 692 is less than the distance L between the clip portions 624. The retainer 692 is then inserted into the openings 622 and released. The retainer is secured in place by the force exerted by the biasing member 695.

Figure 13:
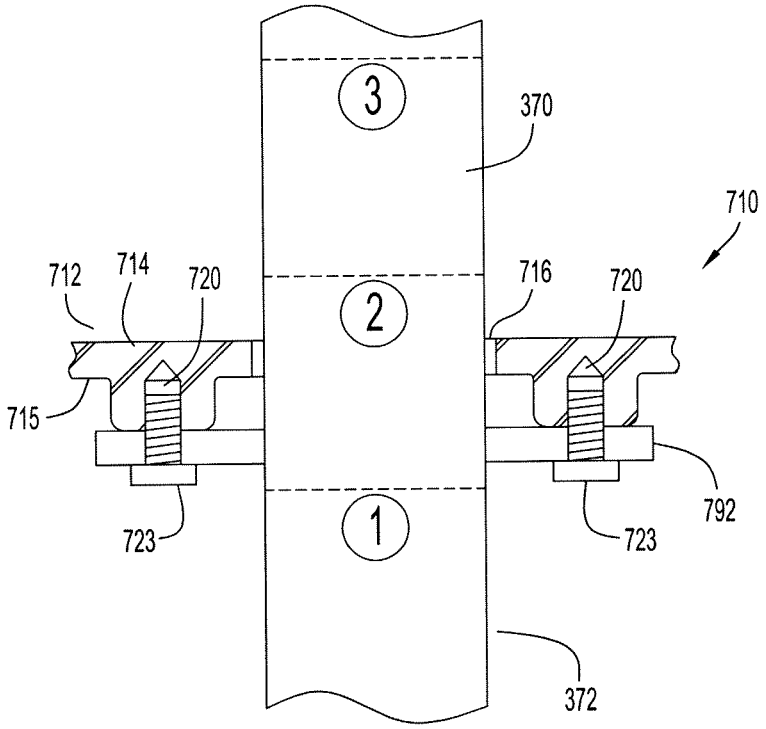
FIG. 13 is a cross-sectional view of an attachment portion of a jumping device according to an embodiment of the invention.

FIG. 13 illustrates yet another embodiment in which a retainer 792 is secured to a bottom surface 715 of an attachment portion 712 by one or more fasteners 723. In the illustrated embodiment, a child support member 710 includes an attachment portion 712 having a top surface 714 and a bottom surface 715. As described above, the attachment portion 712 defines an opening 716 through which the second end portion 372 of the resilient member 370 is disposed. The bottom surface 715 of the attachment portion 712 defines a set of holes 720, each configured to receive a fastener 723. In use, the retainer 792 is removably coupled to the bottom surface 715 by the fasteners 723. The fasteners 723 can be, for example, threaded screws, locking pins, and the like.

Figure 14:
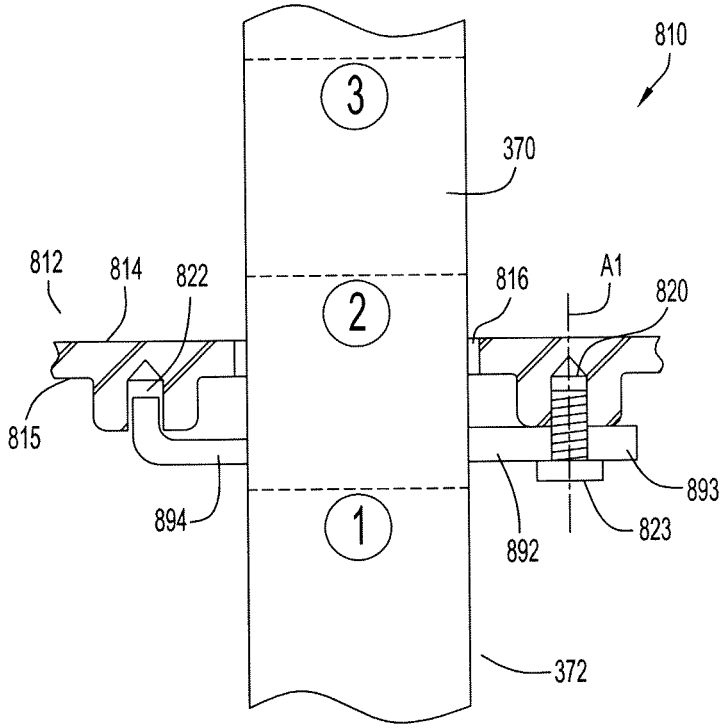
FIG. 14 is a cross-sectional view of an attachment portion of a jumping device according to an embodiment of the invention.

FIG. 14 illustrates yet another embodiment in which a retainer 892 is pivotably coupled to a child support member 810. In the illustrated embodiment, a child support member 810 includes an attachment portion 812 having a top surface 814 and a bottom surface 815. As described above, the attachment portion 812 defines an opening 816 through which the second end portion 372 of the resilient member 370 is disposed. The bottom surface 815 of the attachment portion 812 defines a hole 820 and a slot 822. The hole 820 is configured to receive a fastener 823, thereby allowing a first portion 893 of the retainer 892 to be pivotably coupled to the child support member 810. The slot 823 is configured to receive a second portion 894 of the retainer 892. In use, the position of the child support member 810 can be adjusted by rotating the retainer 892 about axis A1 between a first (locked) position, in which the second portion 894 of the retainer 892 is disposed within the slot 822, and a second (unlocked) position, in which the second portion 894 of the retainer 892 is not disposed within the slot 822. When the retainer 892 is in the second position, a sleeve (not shown) of resilient member 370 can be removed from the retainer 892 and repositioned accordingly. In this manner, the position of the child support member 810 can be repeatedly adjusted without removing the retainer 892 from the child support member 810.

In some embodiments, the first portion 893 of the retainer 892 can be pivotably coupled to the child support member 810 without a fastener 823. For example, in some embodiments, the first portion of the retainer can be configured to snap into the hole, thereby pivotably coupling the retainer to the child support member.

In some embodiments, the retainer is securely coupled to the bottom surface of the attachment portion by a spring loaded clasp. In other embodiments, the retainer is securely coupled to the bottom surface of the attachment portion by one or more elastic bands configured to receive an end portion of the retainer. In yet other embodiments, retainer is securely coupled to the bottom surface of the attachment portion by a magnetic force.

The retainer 392 can be fabricated from a variety of different materials and have a variety of different shapes. For example, in some embodiments, the retainer can have a circular cross-section, as shown in FIGS. 10B and 12. In other embodiments, the retainer 392 can be a flat plate having a rectangular cross-section. In yet other embodiments, the retainer 392 can have an arcuate shape. Similarly, the retainer 392 can be fabricated from an alloy, a plastic, a composite, or any other suitable material.

In some embodiments, the tray portion 308 of the child support member 310 is monolithically formed to include the attachment portion 312. In other embodiments, the attachment portion is a separate component coupled to the child support member.

Figure 15A:
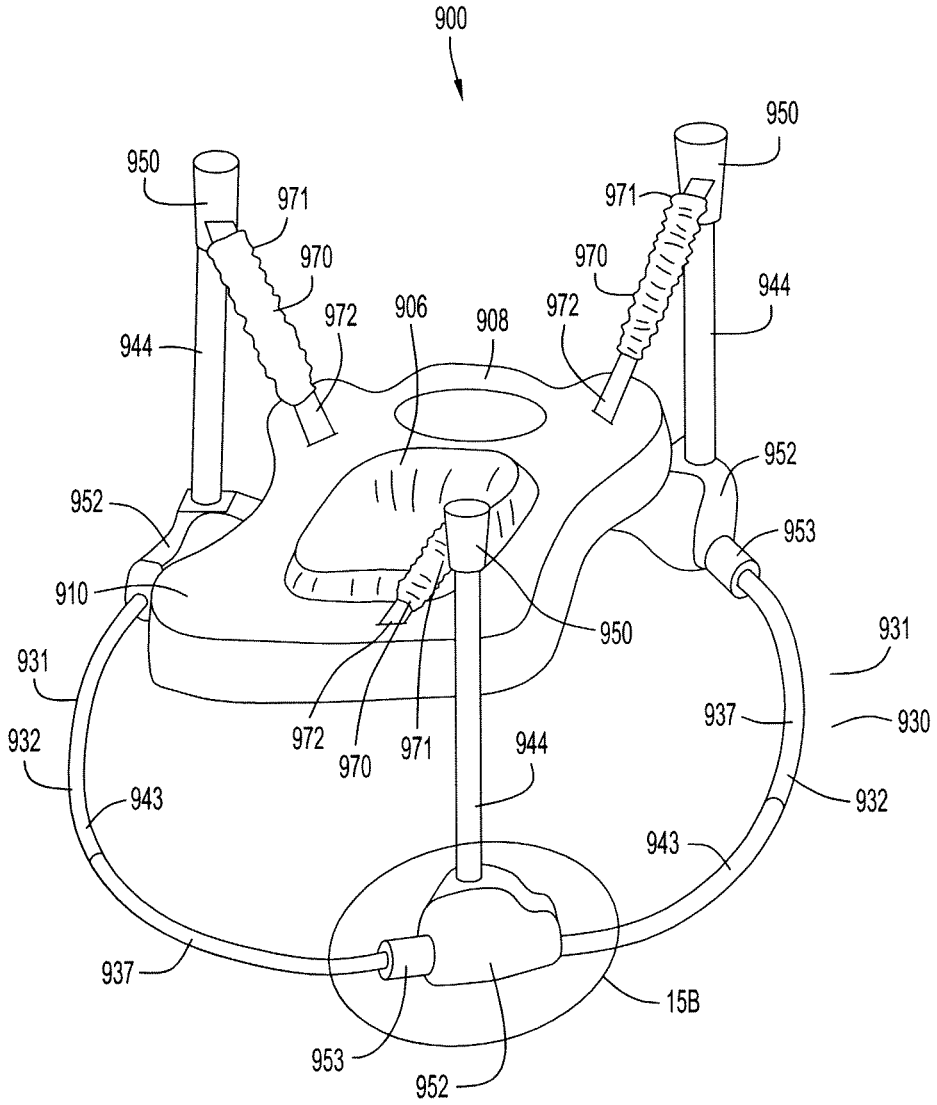
FIG. 15A is a perspective view of a jumping device having a support frame having three frame portions according to an embodiment of the invention.

FIG. 15A illustrates a jumping device 900 according to an embodiment of the invention that includes a support frame 930, three resilient members 970 and a child support member 910. The child support member 910 includes a tray portion 908 and a seat 906. The resilient members 970 are similar to those described above, each having a first end portion 971 coupled to the support frame 930 and a second end portion 972 coupled to the child support member 910. In this manner, the child support member 910 is suspended from the support frame 930 by the resilient members 970.

In some embodiments, the position of the child support member 910 relative to the support frame 930 can selectively adjustable, as described above. For example, in some embodiments, the second end portion 972 of each of the resilient members 970 can include a set of sleeves (not shown), each sleeve being configured to receive a portion of a retainer (not shown). The retainer can be configured to be coupled to the child support member 910 such that a portion of the retainer can be repeatably disposed within a different sleeve from the set of sleeves, thereby allowing the position of the child support member 910 to be adjusted. In other embodiments, the second end portion 972 is fixedly coupled to the child support member 910. In yet other embodiments, the sleeve and retainer feature can be configured to adjust the position of the child support member 910 at the first end portion 971 of the resilient members 970.

The support frame 930 includes three frame portions 931, each including an upright portion 944 and a base portion 932. Each base portion 932 includes a first base member 943 and a second base member 937, a portion of which is configured to be disposed within the first base member 943. In this manner, the base portions 932 can be selectively placed in an expanded configuration when the jumping device 900 is in use and a more compact configuration when the jumping device 900 is not in use. In some embodiments, for example, the first base member 943 and the second base member 937 are tubes, with the inner diameter of the first base member 943 being larger than the outer diameter of the second base member 937, thereby allowing a portion of the second base member 943 to be slidably disposed within the first base member 943. In some embodiments, the base portions 932 can include a locking mechanism, such as a detent, configured to securely maintain the base portion 932 in the desired (e.g., assembled or disassembled) configuration. In yet other embodiments, the base portion 932 does not include a first base member 943 and a second base member 937, but is rather a single, monolithically formed portion of the frame portion 931.

Figure 15B:
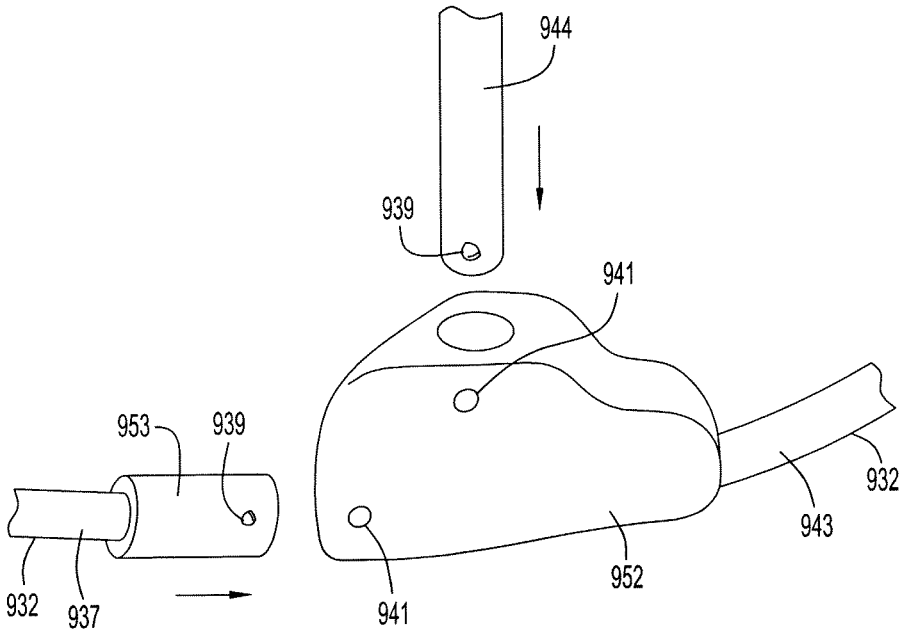
FIG. 15B is a perspective view of the region marked 15B of the jumping device illustrated in FIG. 15A.

The first base member 943 of each base portion 932 includes a first connector 952 and the second base member 937 of each base portion 932 includes a second connector 953. The second connector 953 of one of the frame portions 931 is configured to engage the first connector 952 of another of the frame portions 931 such that the three frame portions 931 can be interconnected to form the support frame 930, as illustrated in FIG. 15A. As illustrated in the exploded view in FIG. 15B, in some embodiments, the first connector 952 can be a female connector configured to receive a male portion of the second connector 953. The second connector 953 can include a locking mechanism 939, such as a tab, detent and the like, configured to be received by a mating portion 941, such as a hole, located on the first connector 952. In other embodiments, the connectors can be of any type suitable for removably coupling the frame portions together. In some embodiments, for example, the first and second connectors 952, 953 can be separate components coupled to the first and second base members 943, 937, respectively, as illustrated in FIGS. 15A and 15B. In other embodiments, the base members can be monolithically formed to include the connectors.

The upright portion 944 of each frame member 931 includes an attachment portion 950 configured to engage the first end portion 971 one of the resilient members 970. In some embodiments, the attachment portion 950 can be a separate component coupled to the upright portion. In other embodiments the attachment portion 950 is not a separate component, but rather, is integral to the upright portion 944 of the frame members 931.

In some embodiments the first end portion 971 is fixedly attached to the attachment portion 950. For example, the first end portion 971 can be molded into a portion of the attachment portion 950. In other embodiments, the first end portion 971 is removably attached to the attachment portion 950. For example, the first end portion 971 can be adjustably coupled to the attachment portion 950 by a sleeve-and-retainer combination of the type described above.

In some embodiments, the upright portion 944 of each frame member 931 can be removably coupled to the first connector 952. In this manner, the frame members 931 can be conveniently disassembled for storage purposes when the jumping device 900 is not in use. As illustrated in FIG. 15B, the first connector 952 can be configured to receive a portion of the upright portion 944. The upright portion 944 can include a locking mechanism 939, such as a tab, detent and the like, configured to be received by a mating portion 941, such as a hole, located on the first connector 952.

As discussed above, the support frame can be selectively placed in an expanded configuration when the jumping device is in use and a more compact, collapsed configuration when the jumping device is not in use. FIGS. 16A-16D are schematic plan view illustrations of a support frame 1030 according to an embodiment of the invention in a various different configurations. The support frame 1030 includes three frame portions 1031, each including an upright portion 1044 and a base portion 1032. Each base portion 1032 includes a first base member 1043 and a second base member 1037, a portion of which is configured to be disposed within the first base member 1043.

Figure 16A:
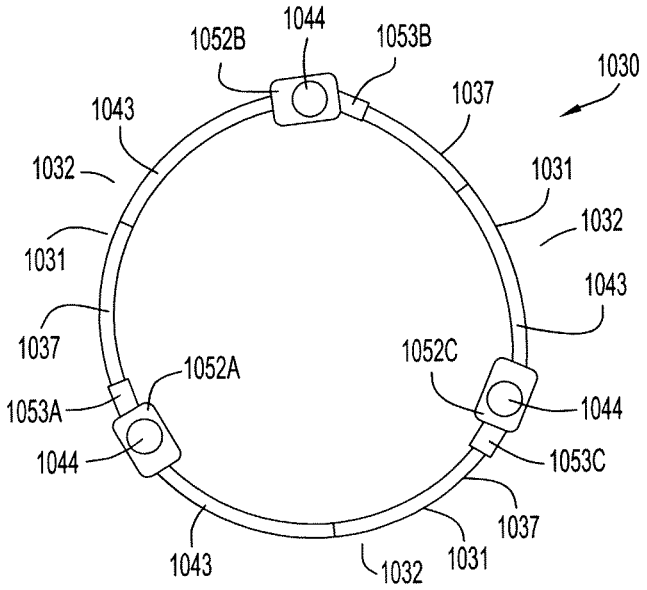
FIGS. 16A-16D are schematic plan view illustrations of a support frame according to an embodiment of the invention in various different positions.
Figure 16B:
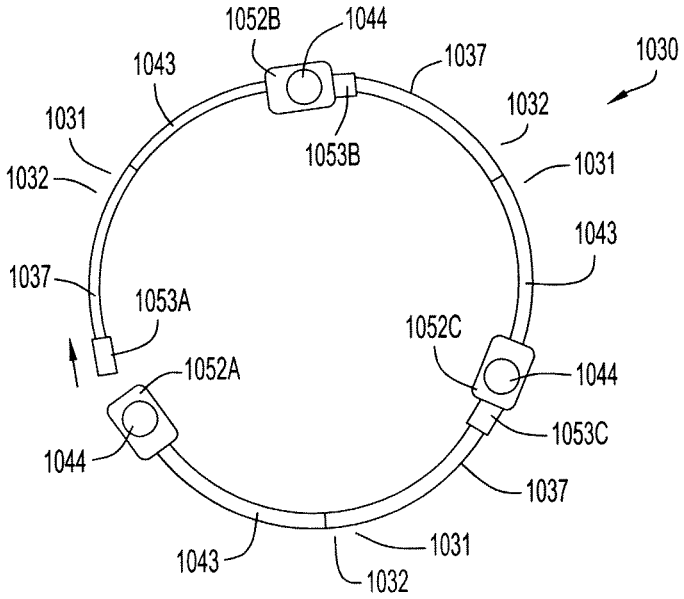
Figure 16C:
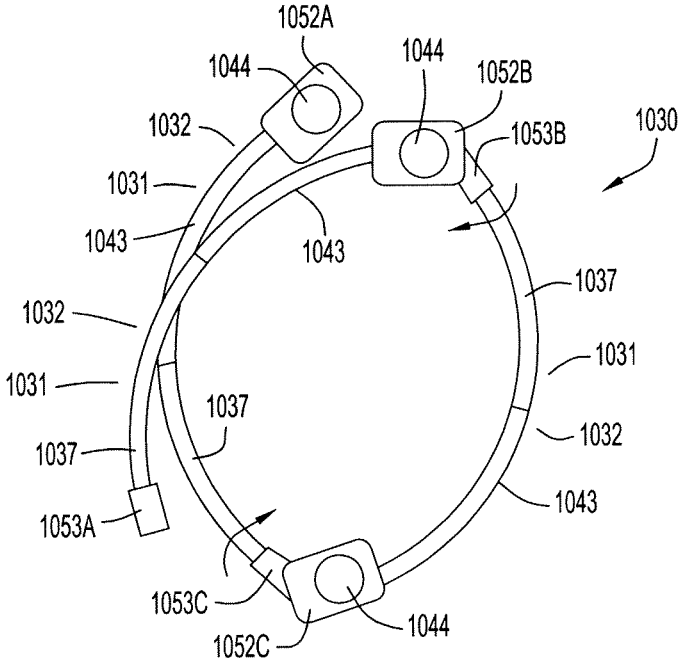
Figure 16D:
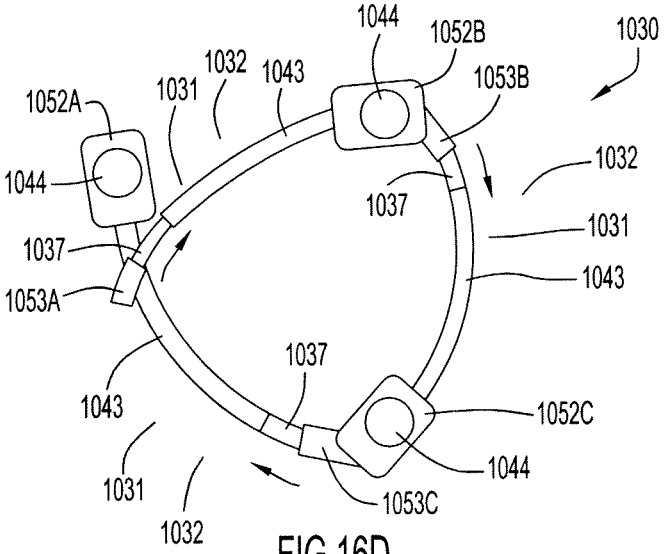

As described above, the first base member 1043 of each base portion 1032 includes a first connector 1052 and the second base member 1037 of each base portion 1032 includes a second connector 1053. The second connector 1053 of one of the frame portions 1031 is configured to engage the first connector 1052 of another of the frame portions 1031 such that the three frame portions 1031 can be interconnected to form the support frame 1030, as illustrated in FIG. 16A. In some embodiments, the mating connectors can be configured to removably engage each other as described above, such that the frame portions can be removably interconnected. In other embodiments, the mating connectors can be configured to pivotably engage each other such that frame portions can be pivotably interconnected, thereby allowing the frame portions to be foldably placed in a collapsed configuration when the jumping device is not in use. In yet other embodiments, the mating connectors can be configured to both removably and pivotably engage each other.

As illustrated in FIGS. 16A-16D, in some embodiments, some of the mating connectors are configured to removably engage each other, while other of the mating connectors are configured to pivotably engage each other. In use, the support frame 1030 can be repeatably transitioned from an expanded configuration (FIG. 16A) to a collapsed configuration (FIG. 16D) as described herein. First the second connector 1053A is removed from the first connector 1052A, as shown by the arrow in FIG. 16B. Each of the second connectors 1053B and 1053C are then pivoted within the first connectors 1052B and 1052C, respectively, as shown by the arrows in FIG. 16C. In this manner, the frame portions 1031 can be pivoted with respect to each other, thereby allowing the support frame 1030 to be placed in a more compact configuration. Finally, as shown by the arrows in FIG. 16D, each of the second base members 1037 is disposed within the respective first base member 1043.

Figure 17:
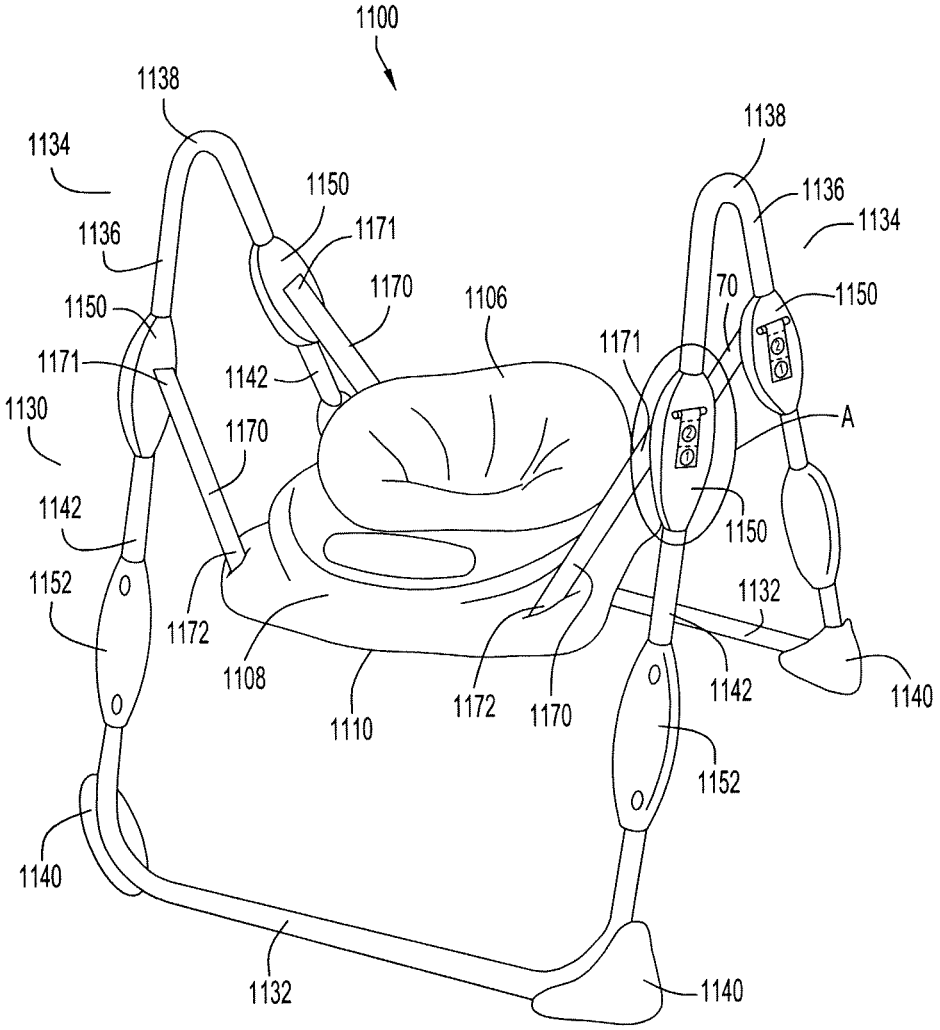
FIG. 17 is a perspective view of a jumping device according to an embodiment of the invention.
Figure 18:
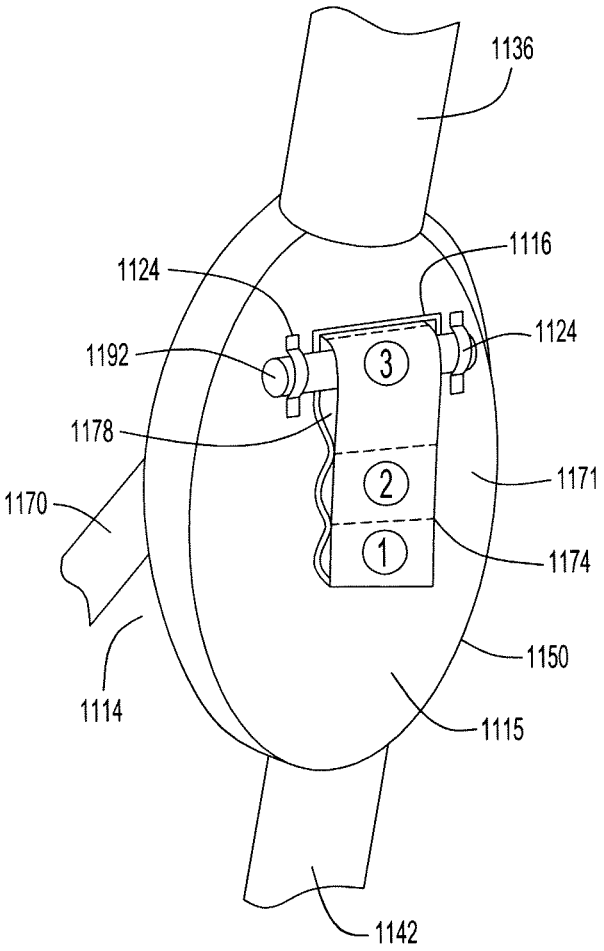
FIG. 18 is a perspective view of a portion of the jumping device illustrated in FIG. 17.

FIGS. 17 and 18 illustrate a jumping device 1100 according to an embodiment of the invention that includes a support frame 1130, four resilient members 1170, a child support member 1110 and a retainer 1192 associated with each resilient member 1170 (see FIG. 15). As described above, the child support member 1110 includes a tray portion 1108 and a seat 1106. The resilient members 1170 are similar to those described above, each having a first end portion 1171 having a set of sleeves 1174 and a second end portion 1172. The second end portion 1172 is coupled to the child support member 1110. A portion of each retainer 1192 is disposed within a sleeve from the set of sleeves 1174 (see FIG. 18). Each retainer 1192 is coupled to the support frame 1130, thereby coupling the first end portion 1171 of each resilient member 1170 to the support frame 1130 such that the child support member 1110 is suspended from the support frame 1130. As described above, the position of the child support member 1110 relative to the support frame 1130 is selectively adjustable by disposing the portion of each retainer 1192 within a different sleeve from the set of sleeves 1174 in each resilient member 1170.

As illustrated in FIG. 17, the support frame 1130 includes two A-shaped portions 1134 spaced laterally from and opposite each other. Each A-shaped portion 1134 includes a top portion 1136 that defines an apex 1138 and two mid portions 1142. An attachment member 1150 is disposed between each mid portion 1142 and the top portion 1136. As discussed in more detail herein, the attachment members 1150 also serve to attach the resilient members 1170 to the support frame 1130. The A-shaped portions 1134 are coupled together by two base members 1132, one positioned towards the front of the jumping device 1100 and one positioned towards the rear of the jumping device 1100. The ends of the base members 1132 are coupled to the mid portions 1142 of the A-shaped portion 1134 by connectors 1152.

The base members 1132 are substantially U-shaped and include feet 1140 attached at the ground-engaging corners of each base member 1132. The feet 1140 are configured to substantially contact a support surface when the jumping device 1100 is in a deployed configuration. The feet 1140 are slip-resistant to help maintain the jumping device 1100 in a desired location. The feet 1140 can be, for example, plastic, rubber or any other suitable material.

In some embodiments, the connectors 1152 are configured to slidably receive the ends of the base members 1132 and the mid portions 1142 and include a height adjustment mechanism. The operation of such a height adjustment mechanism is described in U.S. Pat. No. 6,932,709, entitled "Free-Standing Jumping Device," which is incorporated herein by reference in its entirety. In other embodiments, the connectors 1152 include a quick-connect mechanisms that allow for the base members 1132 to be easily removed for storage purposes.

In some embodiments, the mid portions 1142 and the top portion 1136 are separate components joined by the attachment member 1150. In some embodiments, for example, an end portion of each mid portion 1142 is pivotably coupled to its adjacent attachment member 1150. In other embodiments, only the two mid portions 1142 towards the front of the jumping device 1100 are pivotably coupled to their adjacent attachment members 1150, while the two mid portions 1142 towards the rear of the jumping device 1100 are fixedly coupled to their adjacent attachment members 1150. In this manner, the jumping device 1100 can be conveniently folded for storage purposes. In yet other embodiments, the attachment members 1150 include a quick-connect mechanisms that allow for easy removal of the mid portions 1142 and/or the top portions 1136.

As illustrated, the attachment members 1150 also serve to attach the resilient members 1170 to the support frame 1130 in a position beneath the apex 1138 of the A-shaped portions 1134 of the support frame 1130. Similar to the attachment portion described above, each attachment member 1150 has a first surface 1114 and a second surface 1115. The attachment member 1150 defines an opening 1116 between the first surface 1114 and the second surface 1115 that receives the first end portion 1171 of the resilient member 1170. A portion of the retainer 1192 is disposed within the opening 1178 of a sleeve from the set of sleeves 1174 and the retainer 1192 is coupled to the second surface 1115 of the attachment member 1150. In the illustrated embodiment, a set of clips 1124 is coupled to the second surface 1115 of the attachment member 1150. The clips 1124 are configured to receive a portion of the retainer 1192 such that the retainer 1192 can be securely coupled to the second surface 1115 of the attachment member 1150.

As shown and described above, many other mechanisms for coupling the retainer 1192 to the second surface 1115 of the attachment member 1150 are contemplated. Similarly, although the attachment member 1150 is shown and described as a separate component disposed between a top portion 1136 and a mid portion 1142 of an A-shaped portion 1134, in some embodiments, the A-shaped portions are monolithically formed to include an attachment portion performing the functions of the attachment member 1150 as described above.

In the illustrated embodiment, the second end portion 1172 is coupled to the child support member 1110. In some embodiments the second end portion 1172 is fixedly attached to the child support member 1110. For example, the second end portion 1172 can be molded into the tray portion 1108 of the child support member 1110. In other embodiments, the second end portion 1172 is removably attached to the child support member 1110. For example, the second end portion 1172 of the resilient member 1170 can be coupled to the child support member 1110 by a fastener, an elastic strap, or by a sleeve-and-retainer combination.

Figure 19:
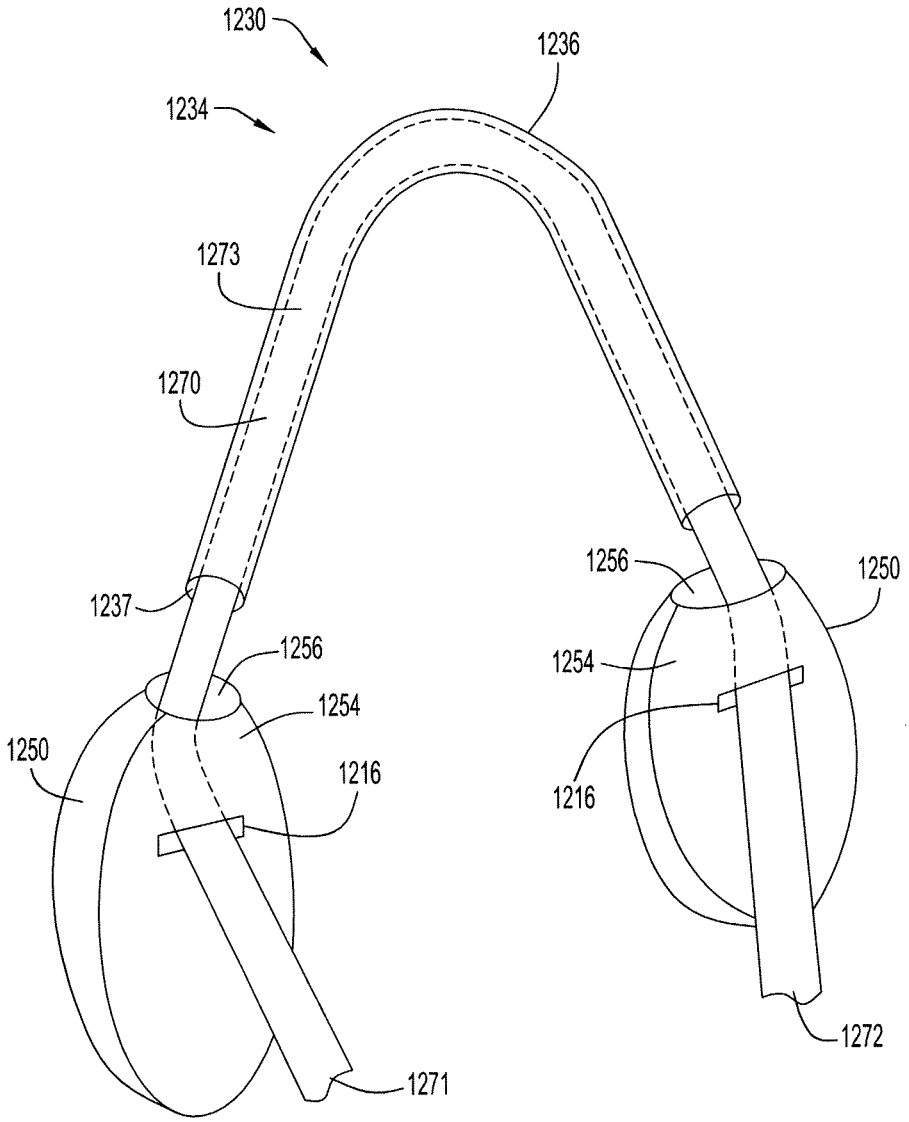
FIG. 19 is a perspective view of a portion of a support frame of a jumping device according to an embodiment of the invention.

Although the A-frame jumping device 1100 is shown and described as having four resilient members 1170, each of which is adjustably attached to the support frame 1130, in some embodiments, a jumping device includes only two resilient members, the ends of which are attached to a child support member. For example, FIG. 19 illustrates a portion of an A-shaped portion 1234 of a support frame 1230 according to an embodiment of the invention. The A-shaped portion 1234 includes a tubular top portion 1236 that defines an interior region 1237. The ends of the top portion 1236 are coupled to attachment members 1250. Each attachment member 1250 includes a side wall 1254 that defines an interior region 1256. The side wall 1254 further defines an opening 1216 that receives a portion of the resilient member 1270. As illustrated, the resilient member 1270 is disposed through each opening 1216 such that its first end portion 1271 and its second end portion 1272 are disposed outside of the A-shaped portion 1234 of the support frame 1230, while a central portion 1273 of the resilient member is disposed within the interior region 1237 of the top portion 1236. In this manner, the first end portion 1271 and the second end portion 1272 can each be coupled to a child support member (not shown), while the central portion 1273 cooperates with the top portion 1236 to support the child support member (not shown).

In some embodiments, each of the first end portion 1271 and the second end portion 1272 include a set of sleeves (not shown) and are adjustably coupled to the child support member (not shown). In other embodiments, one of the end portions is fixedly coupled to the child support member, while the other end portion includes a set of sleeves and is adjustably coupled to the child support member in a manner as described above.

In some embodiments, a portion of the resilient member 1270 is not disposed within the support frame 1230. For example, in some embodiments, the support frame includes a series of eyelets or rings through which the resilient member is disposed.

Figure 20:
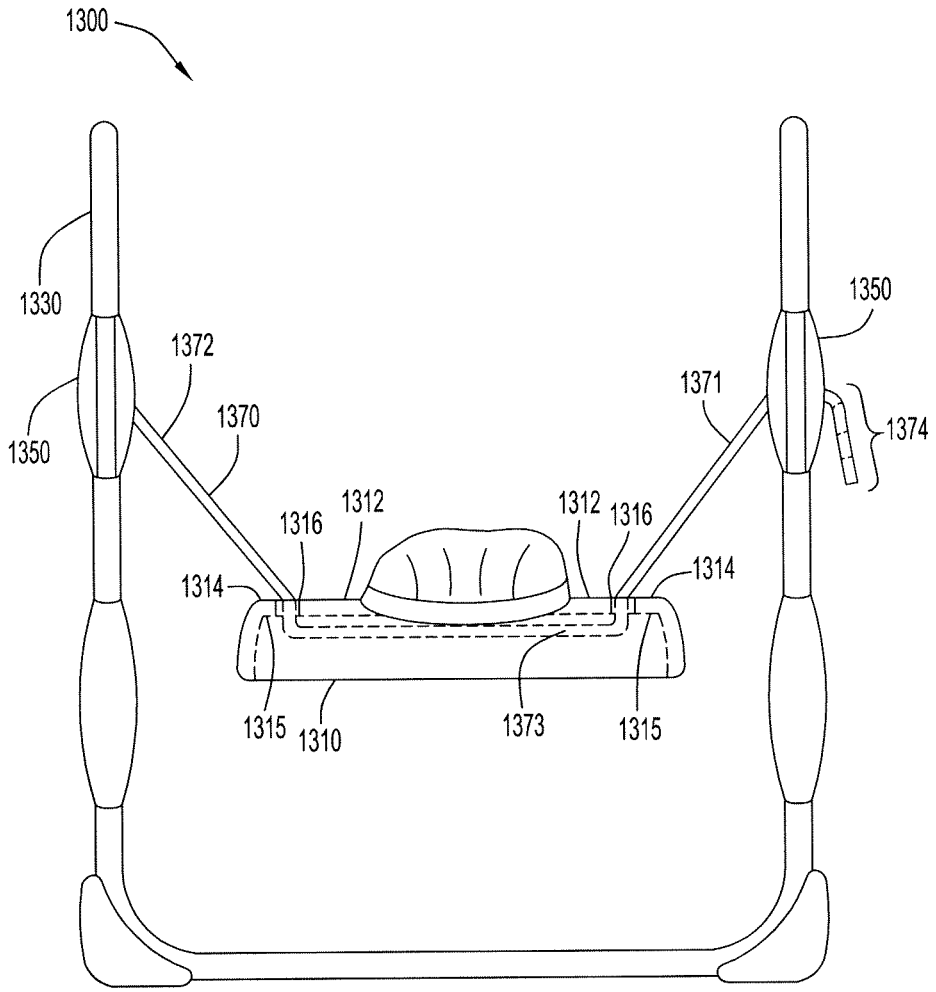
FIG. 20 is a front view of a jumping device according to an embodiment of the invention.
Figure 21:
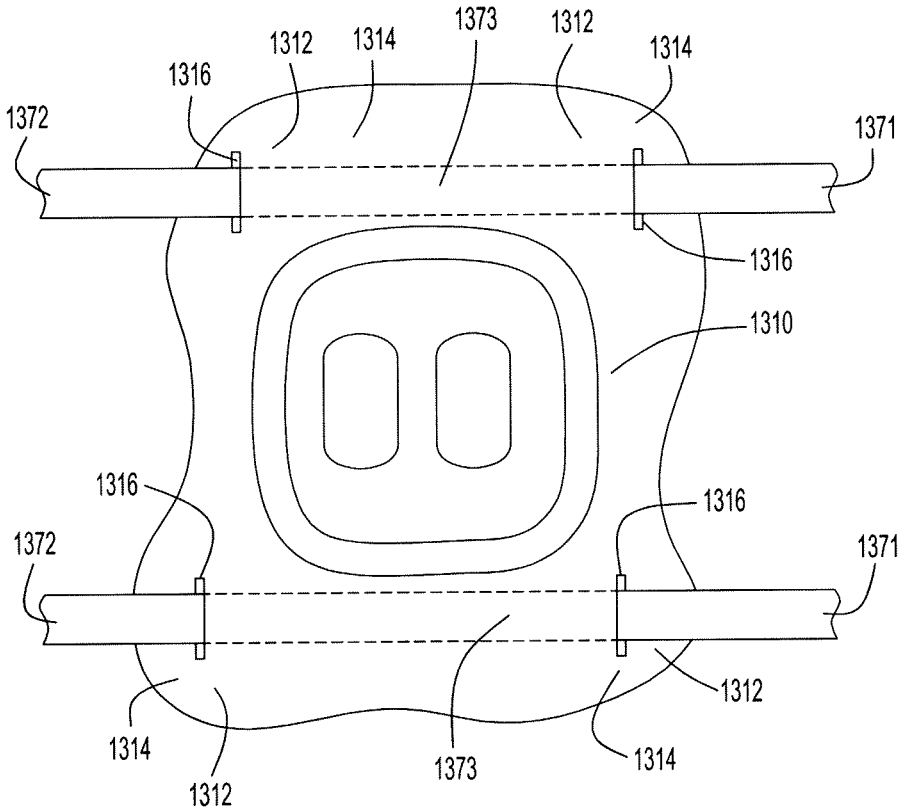
FIG. 21 is a plan view of a portion of the jumping device illustrated in FIG. 20.

FIGS. 20 and 21 illustrate a jumping device 1300 similar to the jumping device 800 described above, except that the jumping device 1300 includes only two resilient members 1370, one of which is disposed towards the front of the jumping device and one of which is disposed towards the rear of the jumping device. In the illustrated embodiment, the resilient members 1370 have a first end portion 1371, a second end portion 1372 and a central portion 1373. The first end portion 1371 includes a set of sleeves 1374 and is adjustably coupled to an attachment member 1350 of the support frame 1330 in a manner similar to that described above. The second end portion is fixedly coupled to an attachment member 1350 of the support frame 1330. The central portion 1373 is coupled to the child support member 1313 such that the child support member 1313 is suspended by the resilient members 1370.

In the illustrated embodiment, the child support member includes attachment portions 1312, each of which includes a top surface 1314 and a bottom surface 1315. The attachment portions 1312 define openings 1316 between the top surface 1314 and the bottom surface 1315 that receive a portion of the resilient member 1370. In this manner, central portion 1373 is coupled to the bottom surface 1315 of the attachment portions. Although the illustrated child support member 1313 is monolithically formed to include the attachment portions 1312, in some embodiments the attachment portions are separate components coupled to the child support member. In yet other embodiments, the attachment portions are configured such that the central portions of the resilient members are coupled to the top surface of the attachment portions.

While various embodiments of the invention have been described above, it should be understood that they have been presented by way of example only, and not limitation. For example, although the jumping devices are shown and described as having multiple resilient members, in some embodiments a jumping device according to the invention can include a single resilient member. In yet other embodiments, a jumping device can include a single resilient member having three or more end portions configured to be coupled to a child support portion and/or a support frame.

Similarly, although the resilient members are shown and described has being thin straps, in some embodiments the resilient members can be of any suitable shape, such as, for example, a member having a round cross-sectional shape.

Although the seat frame is shown and described as being rotatably coupled in one embodiment of the invention, it is understood that a rotatably coupled seat can be included in any embodiments of the invention. Conversely, in some embodiments, the seat frame is fixedly coupled to the tray portion. In other embodiments, the seat does not include a seat frame, but rather only includes the padded material coupled directly to the tray portion by a series of fasteners, such as snaps, buttons and/or hook and loop fasteners. In yet other embodiments, the seat does not include a padded material, but rather only includes a seat frame configured to retain a child. In still other embodiments, the child support member is a monolithically formed structure that includes both a tray portion and a seat.

Although specific embodiments are shown and described as having specific mechanisms for attaching the retainer to the child support member and/or the support frame, any of the disclosed attachment mechanisms can be used in any combination to attach any portion of the retainer to the child support member and/or the support frame.

What is claimed is:

1. A free-standing jumping device for a child, the jumping device comprising:

a support frame;

a child seat suspended from the support frame;

a tray portion at least partially surrounding the child seat;

a first resilient member comprising a first end portion coupled to the support frame and a second end portion coupled to the tray portion; and a second resilient member comprising a first end portion coupled to the support frame and a second end portion coupled to the tray portion, wherein the second end portion of at least one of the first resilient member and the second resilient member is selectively repositionable with respect to the tray portion to alter the position of the child seat with respect to the support frame, wherein the support frame comprises:

a first upright member including a base portion to contact a supporting surface and an upright portion;

a second upright member including a base portion to contact the supporting surface and an upright portion; and a connector coupling the first upright member to the second upright member, and wherein repositioning the second end portion of the least one of the first resilient member and the second resilient member effectively shortens the length of the at least one resilient member extending from the child seat to the support frame.

2. The jumping device of claim 1, wherein the child seat comprises a seat frame and material suspended from the seat frame.

3. The jumping device of claim 1, wherein the first resilient member comprises a retainer operable to couple the second end portion of the first resilient member to the child seat.

4. The jumping device of claim 3, wherein:

the tray portion includes an attachment portion; and the retainer couples to the attachment portion of the tray portion.

5. The jumping device of claim 4, wherein:

the tray portion includes a top surface and a bottom surface and a tray portion opening between the top surface and a bottom surface;

the second end portion of the first resilient member passes through the tray portion opening; and the attachment portion defines a set of holes along the bottom surface, each hole being configured to receive the retainer.

6. The jumping device of claim 1, wherein:

the tray portion has a first opening and a second opening;

the first resilient member extends through the first opening, coupling to a bottom surface of the tray portion; and the second resilient member extends through the second opening, coupling to the bottom surface of the tray portion.

7. The jumping device of claim 1, wherein:

the tray portion includes a top surface and a bottom surface; and the second end portions of each of the first and second resilient members being repositionably couplable to the bottom surface of the tray portion.

8. A free-standing jumping device for a child, the jumping device comprising:

a support frame;

a child seat suspended from the support frame;

a tray portion at least partially surrounding the child seat;

a first resilient member comprising a first end portion coupled to the support frame and a second end portion which passes through an opening in the tray portion and is coupled to the tray portion; and a second resilient member comprising a first end portion coupled to the support frame and a second end portion which passes through an opening in the tray portion and is coupled to the tray portion, wherein the position of the child seat relative to the support frame is selectively adjustable by shortening or lengthening a section of a resilient member extending from a top surface of the tray portion to the support frame.

9. The jumping device of claim 8, wherein the child seat comprises a seat frame and material suspended from the seat frame.

10. The jumping device of claim 8, wherein the support frame comprises a base portion to contact a supporting surface and an upright portion.

11. The jumping device of claim 8, wherein the support frame comprises:

a first upright member including a base portion to contact a supporting surface and an upright portion;

a second upright member including a base portion to contact the supporting surface and an upright portion, and a connector coupling the first upright member to the second upright member.

12. The infant support structure of claim 8, wherein each resilient member comprises an elastic spring portion and a substantially inelastic strap portion.

13. The jumping device of claim 8, wherein the first end portion of the first resilient member is coupled to an upright portion of the support frame.

14. An infant support structure comprising:

a support frame defining a seating area, and a child support member positioned within the defined seating area, the child support member including a plurality of openings disposed about the child support member; and a plurality of resilient members suspending the child support member from the support frame, the resilient members permitting movement of the child support member with respect to the support frame, wherein each of the plurality of resilient members extends through a corresponding one of said plurality of support member openings, each resilient member comprising an elastic portion and a substantially inelastic portion, wherein repositioning of one or more of the plurality of resilient members within the openings repositions the child support member with respect to the support frame, and wherein the position of the child support member relative to the support frame is selectively adjustable by shortening or lengthening a section of a resilient member extending from a top surface of the child support member to an upright portion of the support frame.

15. The infant support structure of claim 14, wherein:

at least one of the plurality of resilient members comprises a first end portion coupled to the support frame and a second end portion coupled to the child support member; and the second end portion of the at least one of the plurality of resilient members comprises a retainer configured to secure the resilient member second end portion to the child support member.

16. The infant support structure of claim 14, wherein:

the child support member includes an attachment portion defining an attachment opening along a bottom surface of the child support member; and each of the plurality of resilient members comprises a first end portion coupled to the support frame and a second end portion, the second end portion including a retainer that is received into the attachment opening to couple the resilient member to the child support member.

* * * * *